United States Patent [19]

Johnston

[11] Patent Number: 4,660,537

[45] Date of Patent: Apr. 28, 1987

[54] BOW LIMB AND AXLE MOUNT

[75] Inventor: Richard Johnston, Tucson, Ariz.

[73] Assignee: Precision Shooting Equipment Co., Tucson, Ariz.

[21] Appl. No.: 742,421

[22] Filed: Jun. 7, 1985

[51] Int. Cl.[4] ..... F41B 5/00

[52] U.S. Cl. ..... 124/86; 124/24 R; 124/DIG. 1

[58] Field of Search ..... 124/23 R, 24 R, DIG. 1, 124/86; 384/432, 434

[56] References Cited

U.S. PATENT DOCUMENTS

| | | | |
|---|---|---|---|
| 394,407 | 12/1888 | Sibley | 384/434 |
| 2,844,136 | 7/1958 | Folberth | 124/23 R |
| 2,980,158 | 4/1961 | Meyer | 124/23 R |
| 4,061,124 | 12/1977 | Groner | 124/23 R |
| 4,064,862 | 12/1977 | Groner | 124/23 R |

*Primary Examiner*—Leo P. Picard
*Assistant Examiner*—Benjamin Layno
*Attorney, Agent, or Firm*—Jack E. Dominik

[57] ABSTRACT

A molded bow limb which at its remote end receives an axle assembly in a preformed axle mount at the end of the bow which includes a recess for receiving an axle cover, a pair of axle covers being provided at either end of the axle and molded with the axle in position. Thus when the axle cover assembly is mounted in the axle assembly mount at the end of the bow, precision of orientation results, no machining is required, and the force of the bow string and/or cable once in place will hold the axle in place. At the opposite end of the bow, a butt slot is provided to engage a bolt or other pin on the limb mount, and a keeper plate engages a recess in the limb mount so that that end of the bow limb is also secured in place and held in place by the force of the strings.

5 Claims, 6 Drawing Figures

FIG. 1
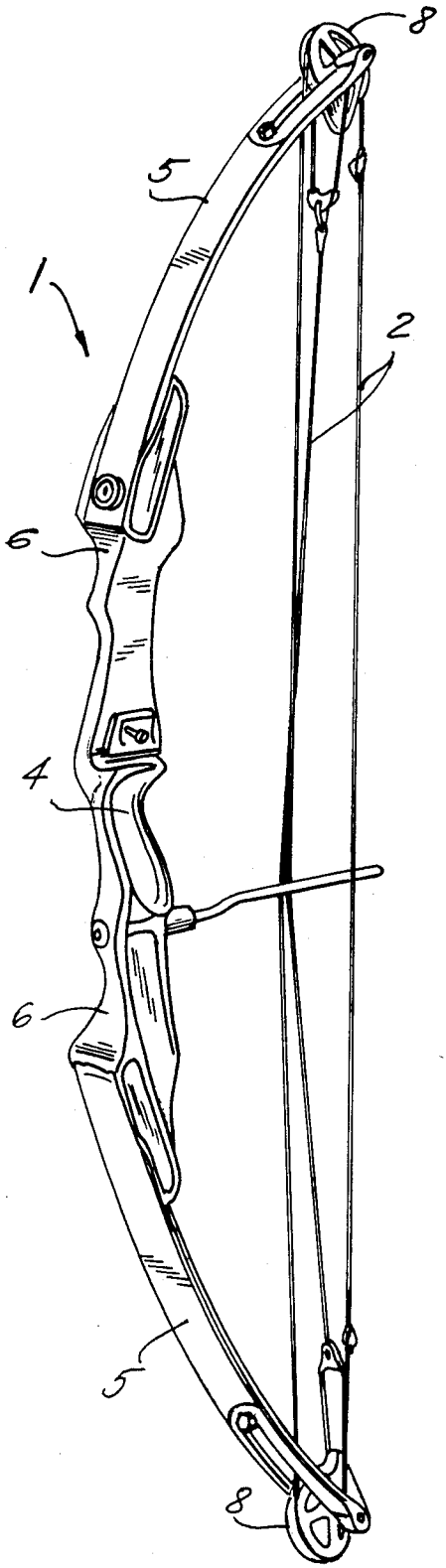
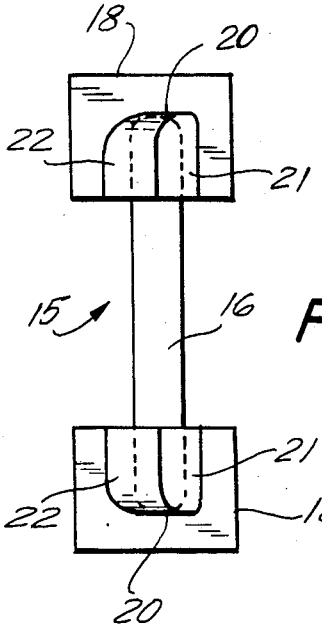
FIG. 5
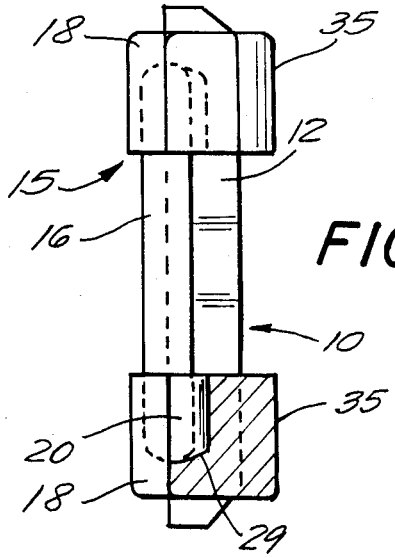
FIG. 6

BOW LIMB AND AXLE MOUNT

FIELD OF THE INVENTION

The present invention relates to archery bows, and more particularly the compound archery bow which has a wheel or a cam mounted at the end portion of each limb. Specifically the invention is directed to a self-energizing mount for an axle at the remote end of the limb, and another self-energizing mount for the limb itself to the limb mount of the bow.

SUMMARY OF THE PRIOR ART

The prior art will be best understood by reference to FIG. 1 of the drawings where a typical compound archery bow 1 is shown. There it will be seen that several bow strings 2 are employed. A hand grip 4 is at the central portion of the bow 1, and terminates in both directions with a limb mount 6 to which the limbs 5 are secured. At the end of each limb 5, a wheel 8 or cam is mounted which permits the compound stringing of the bow. The specific construction of an axle mount is shown in FIG. 2. There it will be seen that the limb A has a fork slot B for the mounting of the wheel or cam on the axle G. Axle holes D are machined into the opposed portions of the fork defined by the fork slot B and then receive the axle C which is secured in place by snap rings E at each end which are mounted on snap ring grooves F provided in the axle C. In machining the end of the limb A in order to receive the axle C, inaccuracies can result, particularly in the orientation of the axle C when the axle holes D are bored. Furthermore it is expensive to machine the axle in order to have the axle snap ring grooves F, and is somewhat cumbersome in the field if restringing is required to remove the snap rings E, restring the bow, and replace the same.

SUMMARY OF THE INVENTION

The present invention is directed to a molded bow limb which at its remote end receives an axle assembly in a preformed axle mount at the end of the bow which includes a recess for receiving an axle cover, a pair of axle covers being provided at either end of the axle and into which the axle ends are inserted. Thus when the axle cover assembly is mounted in the axle assembly mount at the end of the bow, precision of orientation results, no machining is required, and the force of the bow string and cables once in place will hold the axle in place. At the opposite end of the limb, a butt slot is provided to engage a bolt or other pin on the limb mount, and a keeper plate engages a recess in the half round which engages the limb mount socket so that that end of the bow limb is also secured in place and held in place by the force of the strings.

In view of the foregoing it is a principal object of the present invention to provide a bow limb with precise positioning for an axle intended to mount a wheel for a compound bow.

A related object of the present invention is to reduce machining steps in the construction of the axle as well as the ends of the bow limb to thereby deliver a not only more efficient, effective, and precisely dimensioned bow, but reduce the cost of constructing the same.

An additional object of the invention is to provide a method for stringing a bow in which the assembled limb and string are self-energized into locked relationship.

BRIEF DESCRIPTION OF THE DRAWINGS

Further objects and advantages of the present invention will be appreciated as the following description of an illustrative embodiment takes place, taken in conjunction with the accompanying drawings, in which:

FIG. 1 is a perspective view of a typical compound archery bow identifying its principal elements;

FIG. 5 is a plan view of the axle assembly; and

FIG. 6 is an end view of the bow as shown in FIG. 3 showing partially in section and partially in dotted lines the axle assembly mount recess.

DESCRIPTION OF PREFERRED EMBODIMENTS

Figure 2:
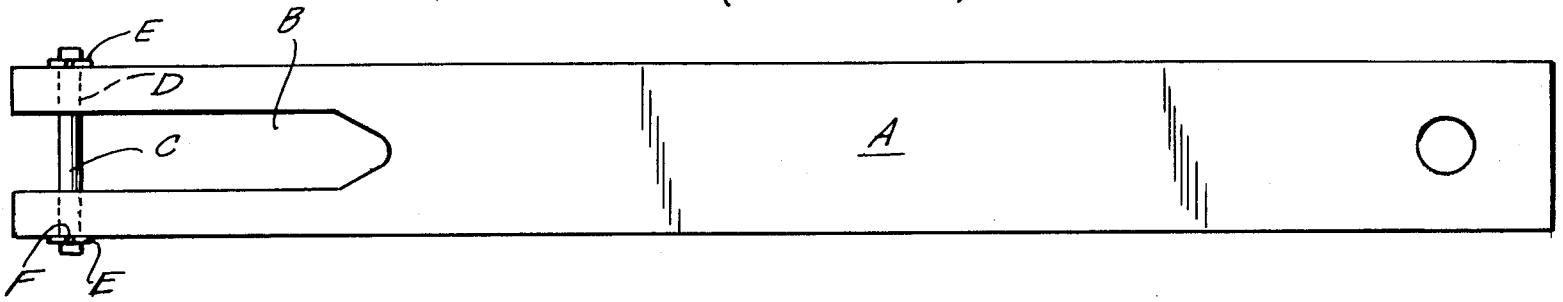
FIG. 2 (PRIOR ART)
FIG. 2 is a plan view of the end of the limb of a typical prior-art compound bow specifically showing how the axle for mounting the wheel is secured in the fork slot.

As set forth in the summary of the prior art, the tpical compound bow 1 is shown in FIG. 1 having a plurality of bow strings 2, a hand grip 4, a limb 5 at each end of the hand grip, the limb 5 being secured to the limb mount 6, and a wheel or cam mounted at the remote end of each of the limbs 5. The present invention is directed to the mounting of the wheel 8 and more specifically the axle. The prior art is shown in FIG. 2 where it will be seen that the limb A contains a fork slot B at the end of which an axle C is mounted transversely. Axle holes D are mounted in the fork members and the axle C secured in place by means of snap rings E which snap into snap ring grooves F provided at the ends of the axle C.

Figure 3:
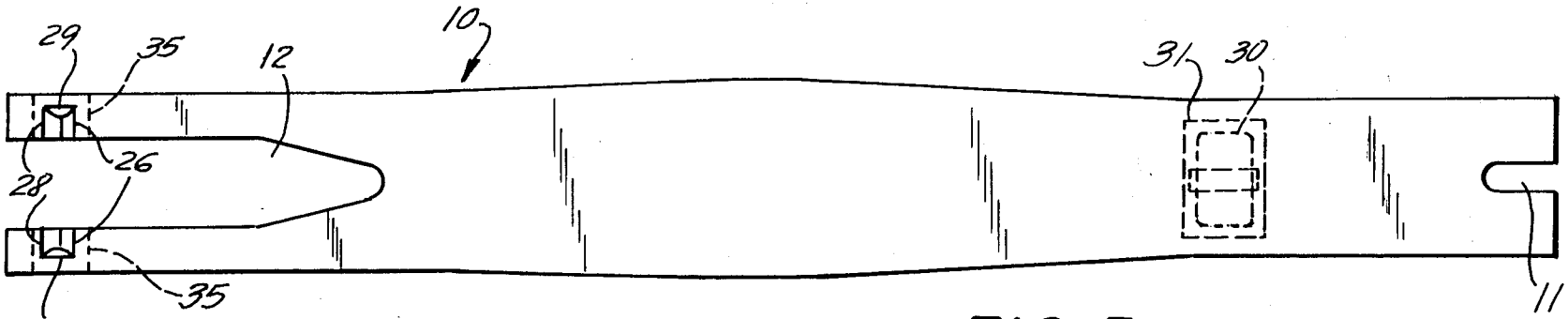
FIG. 3 is a plan view of the limb of a bow illustrative of the present invention.

Turning now to FIG. 3, it will be seen that the limb 10 has a butt slot 11 at one end, and a fork slot 12 at the other. In FIG. 5, the axle assembly 15 is shown where the axle 16 is inserted at each end into the two axles covers 18. The axle cover 18 includes a mounting boss 20, with each mounting boss having a jam face 21, and an end face 22.

Figure 4:
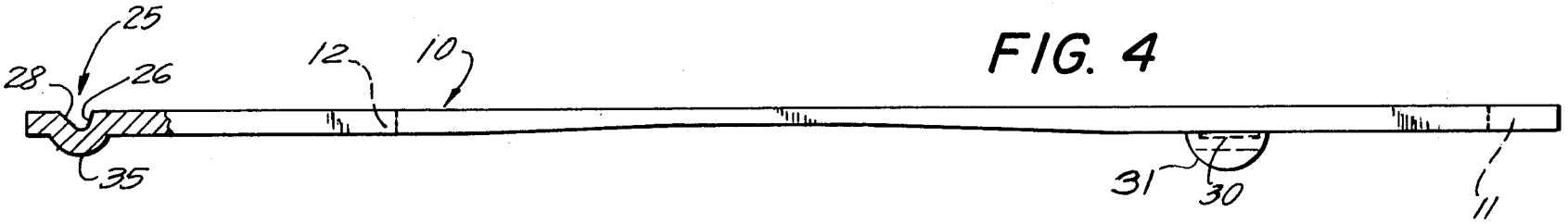
FIG. 4 is a side view of the limb shown in FIG. 3 with the axle mounting assembly shown in sectioned lines.

Reverting now back to FIG. 4, there it will be seen that the axle assembly mount 25 includes a jam face 26 and an end face 28. Sidewalls 29 are provided at each end of the recess, as shown in FIG. 3. Desirably the jam face 26 is at an angle of 7° with a line passed perpendicularly through the end of the bow. The end face is at an angle of 45° with the same perpendicular line. The side walls 29 are rounded as shown in FIG. 6. The axle mounting bosses 20 are proportioned to nestingly engage all of the faces of the axle assembly mount 25.

A keeper plate and half round 30 is provided at the butt end of the limb 10 and coordinates with the butt slot 11 to mount that end of the limb in the limb mount 6 of the archery bow 1. Finally, it will be noted that a reinforcing round 35 is underneath the axle assembly mount 25 to provide for strength at the far end of the limb 10 when the bow is strung.

The method contemplated by the instant invention is a method of mounting a wheel and axle on the end of a bow limb of a compound archery bow. The method comprises the steps of forming a limb 5 having an axle assembly mount in the form of a recess on remote ends flanking a forked slot. A mounting assembly 15 is formed on the axle with a pair of axle covers having the axle assembled therein and having a mounting boss extending beneath each of the axle covers. The mounting boss 20 is formed with faces which are proportioned to nestingly engage a comparable recess in each of the forks flanking the fork slot 12 of the bow limb 10. A butt slot 11 is provided at the remote end of the formed bow limb 10, and coordinates with a keeper plate 30 and half round 31. When the bow is assembled, the butt slot is positioned on a mounting pin while the keeper plate 30 and half round 31 engages a mating recess in the limb mount portion of the bow. Thereafter the axle assembly 15 is positioned in place and the wheel or cam 8 mounted on the axle. This is accomplished by sliding one of the covers off of the axle, inserting the wheel, and then replacing the cover securely. The ends of the covers are provided with a tapered lip to engage the outer edges of the limb. Thereafter the bow is strung, and the tension force in the bow string 2 holds the limb in the limb handle as well as the axle assembly in the axle assembly mount of the bow limb.

Although particular embodiments of the invention have been shown and described in full here, there is no intention to thereby limit the invention to the details of such embodiments. On the contrary, the intention is to cover all modifications, alternatives, embodiments, usages and equivalents of the subject invention as fall within the spirit and scope of the invention, specification, and the appended claims.

What is claimed is:

1. A bow limb and axle mount for a compound archery bow comprising, in combination, a limb, means defining a fork slot at the remote end of the limb, and means defining a butt slot at the opposite end of the limb, said fork slot defining a pair of spaced fork members at the end of the bow limb, an axle mounting assembly in each fork at the end of the bow limb having a recess with a jam face and an end face, said jam face having a lesser angle with an axis perpendicular to the bow limb than the end face, an axle assembly including an axle, and a pair of axle covers located at the remote ends of the axle, and an axle mounting boss extending from each cover having a jam face and an end face and containing an end of the axle, and proportioned to nestingly fit within the axle assembly mount with the respective boss jam faces and end faces abutting the opposite recess jam faces and end faces.

2. In the bow limb and axle mount of claim 1 above, said jam faces having an angle of 7° with the axis perpendicular to the bow limb, and said end faces having an angle of 45° with the axis perpendicular to the axle assembly mount.

3. In the bow limb and axle mount of claim 1, a mounting assembly at the end remote from the axle mount including a butt slot for receiving a mounting member on a bow limb support, and a keeper plate formed in the end of the bow limb to coordinate with the recess on the bow limb mount, whereby both the axle and the bow limb are secured in place by the pre-stressed tensioned force on a bow string.

4. In the bow limb and axle mount of claim 1, said axle assembly mount being molded at the end of the bow limb.

5. In the bow limb and axle mount of claim 1, a keeper plate being molded in the end of the limb intended for engagement with the limb mount.

* * * * *